US007309042B2

(12) United States Patent
Rigas

(10) Patent No.: US 7,309,042 B2
(45) Date of Patent: Dec. 18, 2007

(54) AUTOMATIC POSITIONING DISPENSER FOR PAPER ROLLS

(75) Inventor: Peter E. Rigas, Yardley, PA (US)

(73) Assignee: Pleo Originals, LLC, Yardley, PA (US)

( * ) Notice: Subject to any disclaimer, the term of this patent is extended or adjusted under 35 U.S.C. 154(b) by 462 days.

(21) Appl. No.: 11/067,062

(22) Filed: Feb. 24, 2005

(65) Prior Publication Data

US 2006/0186257 A1 Aug. 24, 2006

(51) Int. Cl.
*B65H 19/00* (2006.01)

(52) U.S. Cl. ..... 242/560.2; 242/596.5; 242/596.8; 242/594

(58) Field of Classification Search ..... 242/560, 242/560.1, 560.2, 560.3, 594, 596.4, 596.5, 242/596.6, 596.8; 312/34.22
See application file for complete search history.

(56) References Cited

U.S. PATENT DOCUMENTS

| | | | | |
|---|---|---|---|---|
| 3,271,090 | A * | 9/1966 | Smithers | 312/34.22 |
| 3,475,067 | A * | 10/1969 | Girard | 312/34.22 |
| 4,108,389 | A | 8/1978 | Womack | |
| 4,322,042 | A | 3/1982 | Wormly | |
| 4,564,148 | A | 1/1986 | Wentworth | |
| 5,000,393 | A | 3/1991 | Madsen | |
| 5,449,127 | A | 9/1995 | Davis | |
| 5,597,133 | A * | 1/1997 | Teague | 242/560.3 |
| 5,765,719 | A | 6/1998 | Upham et al. | |
| 5,868,335 | A | 2/1999 | Lebrun | |
| 6,302,350 | B1 | 10/2001 | Burrell et al. | |
| 6,318,821 | B1 | 11/2001 | Martin et al. | |
| 6,619,504 | B2 | 9/2003 | Ozimec | |
| 2003/0146337 | A1 * | 8/2003 | Moody et al. | 242/594 |

* cited by examiner

*Primary Examiner*—William A. Rivera
(74) *Attorney, Agent, or Firm*—Kenneth P. Glynn, Esq.

(57) ABSTRACT

An automatic positioning dispenser for paper rolls includes (a) a front section of a main housing including a reciprocating paper roll elevator shaft, and a rear section of the main housing including a paper roll storage and feeding mechanism; (b) the elevator shaft having a handle, a roll holder and a reciprocal track, the roll holder having a roll engaging position and a roll disengaging position, the handle and roll holder being moveably connected to one another so as to move together along the reciprocal track, so that when the handle is moved down, it first releases a spent roll, then travels to the bottom and locks onto a new roll, and when the handle is next pulled up, it moves the new roll to the top position for use; and, (c) the paper roll storage and feeding mechanism having sufficient storage area to store a plurality of paper rolls in sequential position, and having feeding means to move a paper roll from the storage area to the bottom of the elevator shaft.

20 Claims, 14 Drawing Sheets

1
103
17
19
9
5
6
7
21
15
3

9
19
29
17
7
5

5
12
7
9
15
3

9
21
15
5
3
7
18
11
85
17

AUTOMATIC POSITIONING DISPENSER FOR PAPER ROLLS

BACKGROUND OF THE INVENTION

1. Field of the Invention

The present invention relates to rolls of paper and similar products that are dispensed on a roll, such as toilet paper, paper towels, etc. The present invention is a dispenser that holds a plurality of rolls in a storage area and one roll for usage. When the one roll being used is finished, the present invention dispenser permits a user to move a handle down, then up, in a single reciprocal movement, wherein the dispenser will eject the spent roll on the down stroke, pick up a new roll and lock onto it at the bottom, and carry the new roll to the top for use.

2. Information Disclosure Statement

The following prior art is representative of the state of the art in the field of paper roll dispensers:

U.S. Pat. No. 4,108,389 describes a cabinet for dispensing paper from paper rolls, such as toilet paper, utilizing two downward-leading pairs of facing flanged channels as tracks in which spindles carrying the paper are engaged. An upper pair of tracks is fixed, while a lower pair of tracks may be pivoted to align the upper and lower tracks for feeding a second roll of paper stored in the upper track to the lower track and into position for dispensing. Previous to pivoting, the upper edge of one channel of the lower track is positioned intermediate the channels of said upper track and supports the second roll of paper. A third roll may be stored in the upper tracks above detent pins, which are inserted into the upper tracks as the second roll is fed into position for dispensing, to prevent the third roll from descending to the lower tracks.

U.S. Pat. No. 4,322,042 describes a toilet paper storage dispenser including an upright enclosure having a central paper roll guide for placing toilet paper rolls into the upper enclosure end circumposed about the guide and withdrawing the rolls from the lower enclosure end journaled on the guide, a lateral extension on the lower guide end and an upstanding connector from the extension rigidly connected to the enclosure, a swingable lid or top wall over the upper enclosure end, and releasable intermitting formations on the inner side of the top wall and upper end of the guide for retraining the latter against movement out of its central alignment within the enclosure.

U.S. Pat. No. 4,564,148 describes a toilet paper dispenser including a roll-storing chamber adapted for incorporation behind a room wall and a pair of facing guides for feeding rolls, one at a time, to an exposed position at least partially in front of the wall. To this end, the chamber has a front wall formed with an opening in a lower portion thereof commensurate with an aperture in the room wall. Each of the facing guides includes a vertical channel within the chamber and a horizontal channel contiguous therewith and extending to a point outside the chamber. The channels are sized and spaced to accommodate spindle ends projecting beyond the end faces of a toilet paper roll to be dispensed. The end portions of the horizontal channels are formed to support a roll in the exposed use position. One or both of the horizontal channels may be formed with an open segment that allows insertion and removal of the spindle.

U.S. Pat. No. 5,000,393 describes a dispenser for rolls of sheet material including an upright roll chamber adapted to support at least three stacked rolls of sheet material, such as toilet paper, including a lower dispensing station, a primary reserve station above the dispensing station, and a secondary reserve station above the primary reserve station. Mounted for operative movement on the opposite sides of the roll chamber at each station is a pair of eccentric rotary actuators, each adapted to rotate about a rotary axis extending front-to-rear, each actuator having a radial projection for entry into and withdrawal from the roll chamber on opposite sides of the rolls at the corresponding station in order to dispense sheet material from the roll at the dispensing station and to feed rolls downward from the upper reserve stations to the dispensing station when the lowermost roll is empty and its empty core has been discharged. The dispenser also includes a combination roll sensing and locking device to prevent the operation of the actuators when a full roll is in the lower dispensing station.

U.S. Pat. No. 5,449,127 describes a dispenser for rolls of sheet material including a base or housing for supporting one or more rolls of sheet material. An extension from one side of the housing includes a receiver for receiving one end of an axle/push rod. A journal is positioned on the opposite side of the housing from the receiver. The journal and the receiver in turn are positioned along an axis. The axle/push rod has a first section which can be inserted into the center passageway through the roll and extend at least slightly out of the opposite side of the roll. A second section of the axle/push rod abutting the side of the roll has a diameter greater than the passageway through the roll and allows the axle/push rod to push the roll rotatably supported on the first section of the housing. The entire length of the axle/push rod is greater than twice the length of the roll. The roll on the axle/push rod is then exposed outside the housing for dispension of sheet material. Once the roll exposed for dispension is expired, the axle is withdrawn from the receiver and withdrawn through the housing, with a half turn the remaining rolls drop in the housing and the axle right side up is reinserted into the next succeeding roll passageway. The axle/push rod is used then to push the next roll out to where it is positioned for dispension.

U.S. Pat. No. 5,765,719 the dispenser and rack for a roll of paper, plastic, or foil, which compromises a magazine for generally vertical disposition having an open bottom, and the inside dimensions of the magazine are sufficient to accommodate at least one roll. A paddle is mounted in the magazine, and a handle affixed to the paddle extends from an opening in the magazine and is free to be moved along the opening so as to actuate the paddle between a lower-most position and an upper-most position. The paddle is arranged so when in its lower-most position, it obstructs the open bottom so as to prevent a roll from dropping the magazine; and when the paddle is actuated to its upper-most position, clearance is provided to allow a roll to drop from the magazine. A suitable bracket depends from the magazine beneath the open bottom, and the paddle allows one roll at a time to drop from the magazine for engagement with the bracket, and is revolvedly mounted on the bracket, thereby exposing the roll for use.

U.S. Pat. No. 5,868,335 describes a tissue roll dispenser provided with a pair of laterally slidable roll holding elements with a longitudinally slidable roll releasing actuator. The roll holding elements are biased towards a roll holding position via a spring connected to both roll holding elements. The roll releasing actuator includes a pointed end provided with opposite lateral edges contacting a respective roll holding element. When the roll releasing actuator is moved from a resting position to an actuating position, the pointed end forces the roll holding elements to move laterally from a roll holding position to a roll releasing position.

U.S. Pat. No. 6,302,350 B1 describes a toilet tissue dispenser compromising a housing. An upper front door in the housing lifts upwardly, so that the multiple toilet paper rolls can be stacked into the housing. The housing has a lower front notch opening, to allow the lowest toilet paper roll to be removed therefrom.

U.S. Pat. No. 6,318,821 B1 describes a tissue roll dispenser apparatus provided for attachment to a tissue roll holder which includes a first spindle end receiver and a second spindle end receiver. The tissue roll dispenser apparatus includes a plurality of tissue rolls to be used in succession. The tissue roll dispenser apparatus includes a first support plug assembly for engagement with the first spindle end receiver and for receiving a first spindle end of a roll spindle. A second support plug assembly engages with the second spindle end receiver and receives a second spindle end of the roll spindle. A first housing extension is connected to the first support plug assembly, and a second housing extension is connected to the second support plug assembly. A tissue roll retention housing, which includes a first housing wall, is connected to the first housing extension. A second housing wall is connected to the second housing extension, and a housing floor extends between the first housing wall and the second housing wall. An uplift spring assembly is retained in the tissue roll retention housing. Stop members are connected to the first and second housing walls. Each of the first support plug assembly and the second support plug assembly includes a plug member reception groove in a respective housing extension.

U.S. Pat. No. 6,619,504 B2 describes a multiple roll holder unit having a magazine in which rolls are stacked, and an associated roll holder having retaining arms moveable on opposite sides of a roll holding area. Actuation of a transfer mechanism having upper and lower cup members hinged at one side with each other causes a transfer of a lowermost one of the rolls in the magazine to the roll holding area as the retaining arms are retracted and set back following the motion of the cup members, releasing at the same time a depleted roll possibly held by the roll holder.

Notwithstanding the prior art, the present invention is neither taught nor rendered obvious thereby.

SUMMARY OF THE INVENTION

The present invention relates to an automatic positioning dispenser for paper rolls. It includes:

(a) a main housing having a front section and a rear section, the front section of the main housing including a reciprocating paper roll elevator shaft, the rear section of the main housing including a paper roll storage and feeding mechanism;

(b) the elevator shaft having a handle, a roll holder and a reciprocal track, the roll holder having a roll engaging position and a roll disengaging position, the handle and roll holder being moveably connected to one another so as to move together along the reciprocal track, the reciprocal track having a first track section and a second track section, and the reciprocal track having a top and a bottom, wherein when the handle and the roll holder are located at the top of the reciprocal track, the roll holder is in the roll engaging position, and when the handle and roll holder are moved from the top to the bottom of the reciprocal track along its first track section, the roll holder is in the roll disengaging position, and when the handle and roll holder are at the bottom of the reciprocal track, the roll holder moves into the roll engaging position, and when the handle and roll holder are moved from the bottom to the top of the reciprocal track along its second track section, the roll holder is in the roll engaging position, such that the roll holder holds a paper roll at the top of the track, releases the paper roll when it moves from the top to the bottom, engages a new paper roll at the bottom and elevates the new paper roll to the top when moved from the bottom to the top; and, (c) the paper roll storage and feeding mechanism having sufficient storage area to store a plurality of paper rolls in sequential position, and having feeding means to move a paper roll from the storage area to the bottom of the elevator shaft.

In some embodiments, the present invention dispenser paper roll storage and feeding mechanism is a single roll width-based storage chute with an inclining base positioned to rely upon gravity feed to move paper rolls from it to the bottom of the elevator shaft. The dispenser paper roll storage and feeding mechanism may be open at the top or the back or the side for stacking, but in many cases, privacy is preferred and, hence, the dispenser may include at least one access door for loading it with a plurality rolls. For example, the paper roll storage and feeding mechanism may include an access door on its top, its side, or its back for loading it with a plurality of paper rolls. It may include two doors, such as two adjacent doors for filling the storage area. The storage area may accommodate three or four or many, such as ten or twelve or fifty rolls, depending on the size and purpose of the rolls as well as on its intended location or environment. For toilet paper in home bathroom dispensing purposes, the storage area will be designed to hold at least three rolls of toilet paper.

In preferred embodiments, the present invention dispenser elevator shaft includes a spent paper roll ejection means located below the top to eject a spent paper roll when the handle is moved from the elevator shaft top downwardly along the first track section.

In some preferred embodiments, the dispenser roll holder includes two opposing protrusions having an outside dimension to fit inside a hollow paper roll, one of the opposing protrusions having track engagements means which is functionally connected to the reciprocal track. The two opposing protrusions have a distance of separation of X when the roll holder is in its roll engaging position to engage a paper roll having a hollow roll width of X+Y, and the two opposing protrusions have a distance of separation of X+Y+Z when the roll holder is in its roll disengaging position, wherein each of X, Y, and Z is a linear measurement, and wherein X is less than X+Y, and X+Y is less than X+Y+Z.

The dispenser elevator shaft may include at least one vertical opening for movement of the handle upwardly and downwardly wherein the handle extends into the shaft and is functionally connected to the roll holder therein. The roll holder may be spring biased toward the roll engaging position.

In some preferred embodiments the present invention dispenser includes a main housing, an elevator shaft and a paper roll storage and feeding mechanism, as now described.

The main housing has a front section and a rear section, the front section of the main housing including a reciprocating paper roll elevator shaft, the rear section of the main housing including a paper roll storage and feeding mechanism. The elevator shaft has a handle, a roll holder and two opposing reciprocal tracks, the roll holder having a roll engaging position and a roll disengaging position, the handle and roll holder being moveably connected to one another so as to move together along the reciprocal tracks. Each of the reciprocal tracks has a first track section and a second track section, and each of the reciprocal tracks has a top and a bottom, wherein when the handle and the roll holder are located at the top of the reciprocal tracks, the roll holder is in the roll engaging position, and when the handle and roll holder are moved from the top to the bottom of the reciprocal tracks along their first track sections, the roll holder is in the roll disengaging position, and when the handle and roll holder are at the bottom of the reciprocal tracks, the roll holder moves into the roll engaging position, and when the handle and roll holder are moved from the bottom to the top of the reciprocal tracks along their second track sections, the roll holder is in the roll engaging position. Thus, the roll holder is engaging and holds a paper roll at the top of the tracks, releases the paper roll when it moves from the top toward the bottom, engages a new paper roll at the bottom and elevates the new paper roll to the top when moved from the bottom to the top and holds it at the top for use. The paper roll storage and feeding mechanism has sufficient storage area to store a plurality of paper rolls in sequential position, and has feeding means to move a paper roll from the storage area to the bottom of the elevator shaft.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

Figure 1:
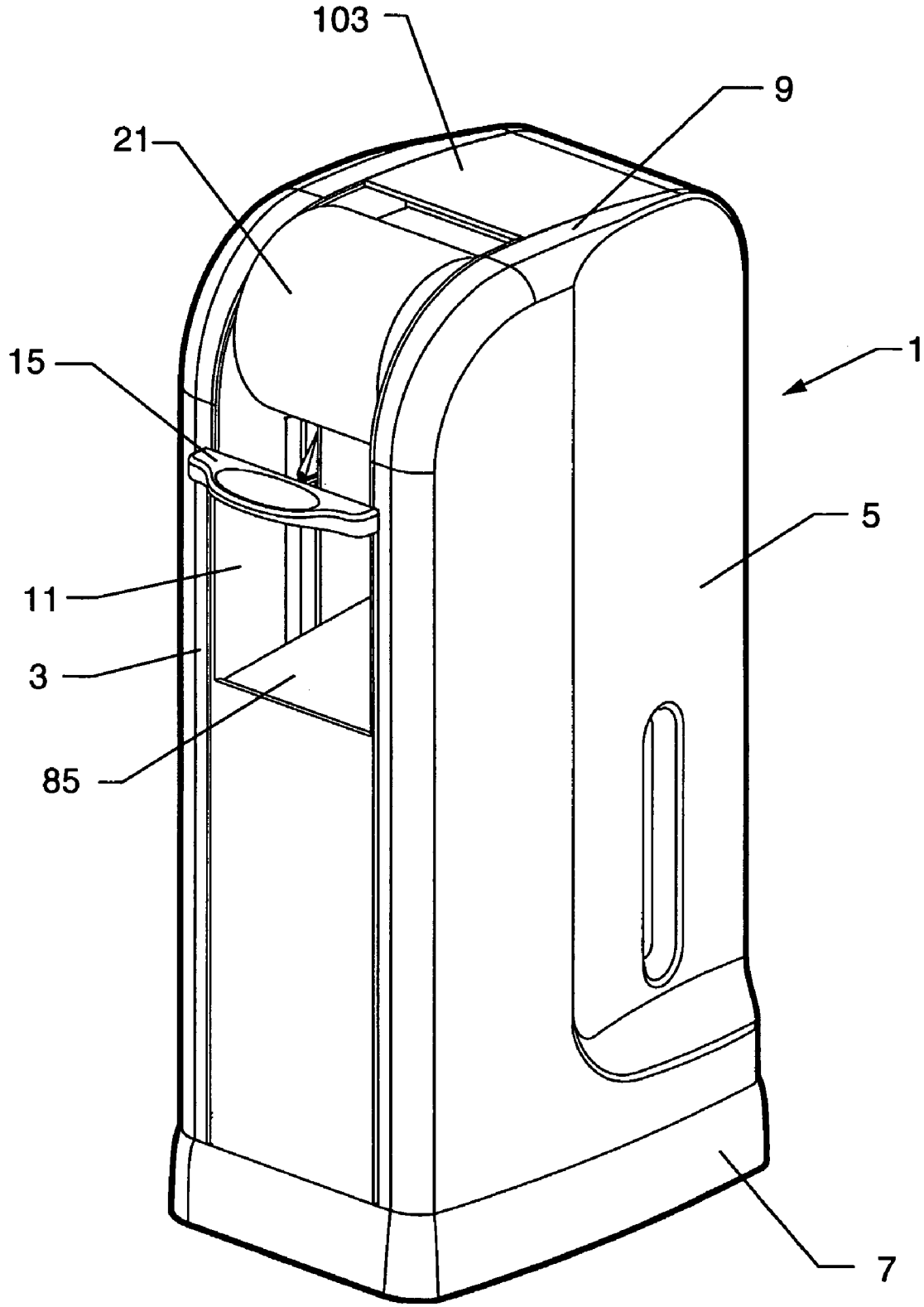
FIGS. 1, 2, 3, 4 and 5 illustrate oblique, front, top, right side and rear views of one embodiment of a present invention paper roll positioning dispenser.
Figures 2, 3, 4, 5:
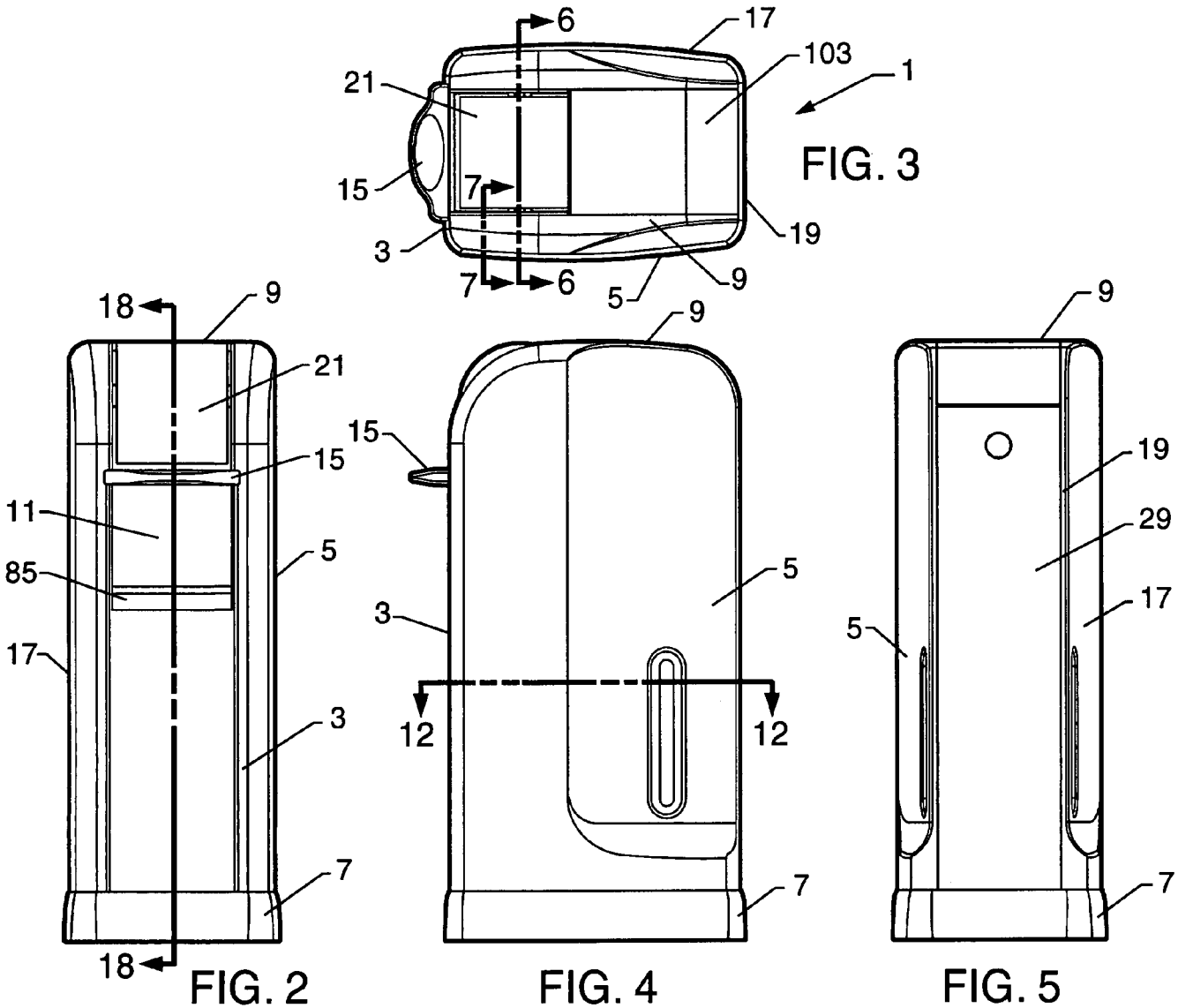

FIGS. 1, 2, 3, 4 and 5 illustrate oblique, front, top, right side and rear views of one embodiment of a present invention paper roll positioning dispenser 1. While dispenser 1 may be used for any type of paper roll, such as paper towels, toilet paper, rolled napkins or tissues, the term "paper roll" is meant here to be broadly interpreted to include any sheet roll that has a plurality of sequential sheets, e.g. perforated, thinned or otherwise designed for pull and rip or pull and cut. Thus, rolled film paper, rolled postage stamps or postage sheets, gummed sheets, rolled peel products, such as paper or plastic sheet tattoos, rolled bags, and other rolled products is included. Paper products in rolls, as well as paper substitutes, such as plastic sheets, bags and the like, is included. Long or wide rolls, such as wall paper, is included. The dispenser need only be designed with appropriate dimensions to accommodate any roll and dispenser product.

FIGS. 1, 2, 3, 4, and 5 are described herein collectively, and the following description should be read with all Figures (not all Figures include all components).

The main housing shown in FIGS. 1 through 5 includes a front section 3, a right side 5, a left side 17, a back section 19, a top section 9, and a bottom section 7. There is a front section elevator shaft 11 and a spent roll ejection means, here, chute 85. Chute 85 is hinged to flip up when a new roll is moved up, but does not swing downward and hence, ejects a downwardly falling (released) roll. This is described in more detail below.

Toilet paper roll 21 is positioned in the elevator shaft top, for use by a user in a normal fashion.

Top section 9 has a door or lid 103 that hinges toward the front and opens up. Back section 9 has a back door 29 that hinges at its bottom and opens down. The opening edge of lid 103 and the opening edge of back door 29 meet so that when both are opened, there is full access to the back section 19 and top section 9 plural roll storage area described below.

Handle 15 is shown protruding from front section 3, and it functionally is also described below.

The dispenser 1 may be made of any available material such as wood, metal or cast material, but plastic or other synthesized material is preferred. Combinations of the foregoing may be employed. Choice of materials of construction may also be dictated by its intended use. A toilet paper dispenser would not require the structural strength or size of a wallpaper dispenser with a cutter. A tape roll dispenser might be a very compact desktop item made of lightweight plastic. The stand-up model for toilet paper dispensing may be made of ABS, styrene, polyethylene, polypropylene, blends, or combinations thereof. This use is represented by the Figures in terms of relative dimensions and sample rolls.

FIGS. 6*a*, 6*b*, 7, 8, 9 and 10 show details of roll holder and track mechanisms. These drawings are described together with identical components being identically numbered. Components already described above may be numbered identically here and need not be described again.

Figure 6A:
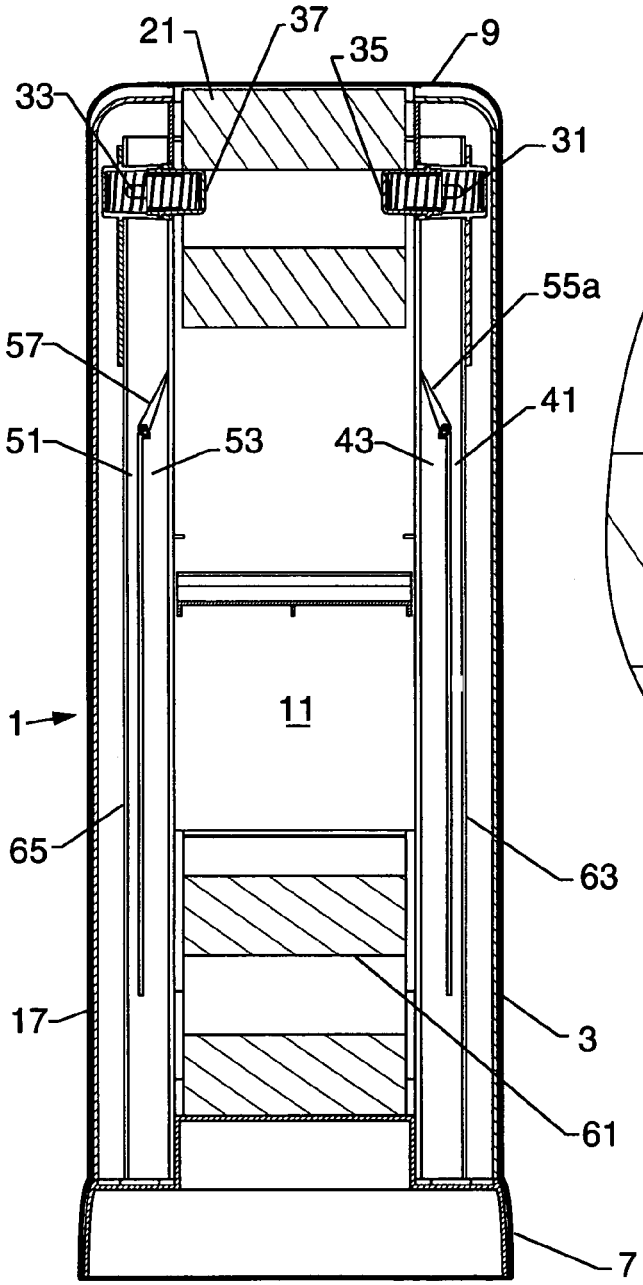
FIGS. 6*a*, 6*b*, 7, 8, 9 and 10 show details of roll holder and track mechanisms.
Figure 6B:
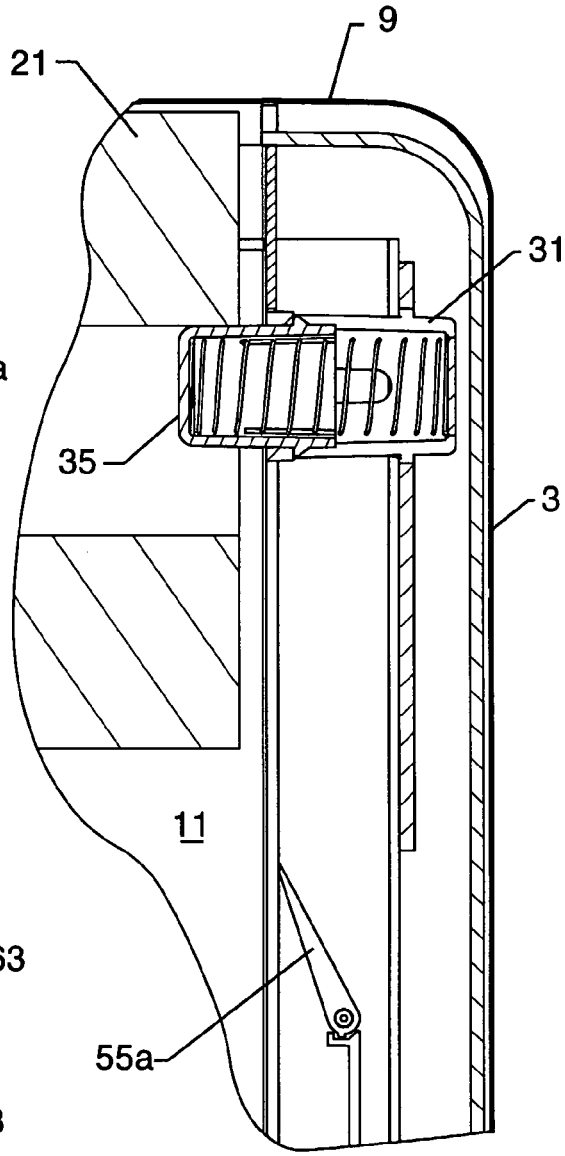
Figure 7:
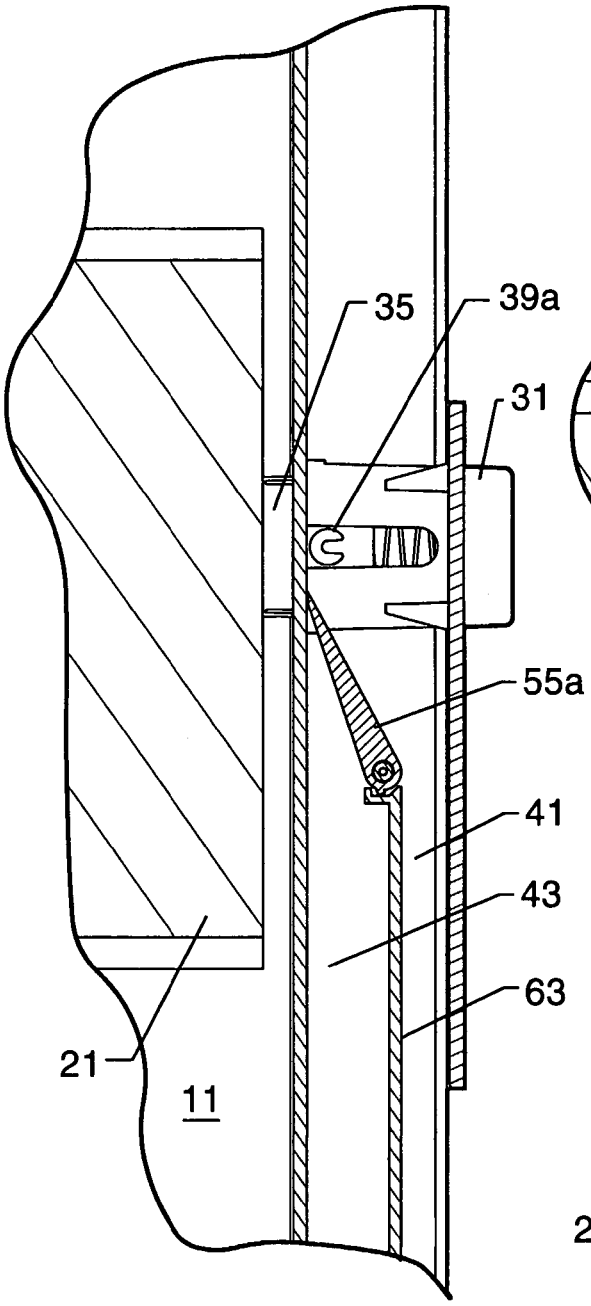
Figure 8:
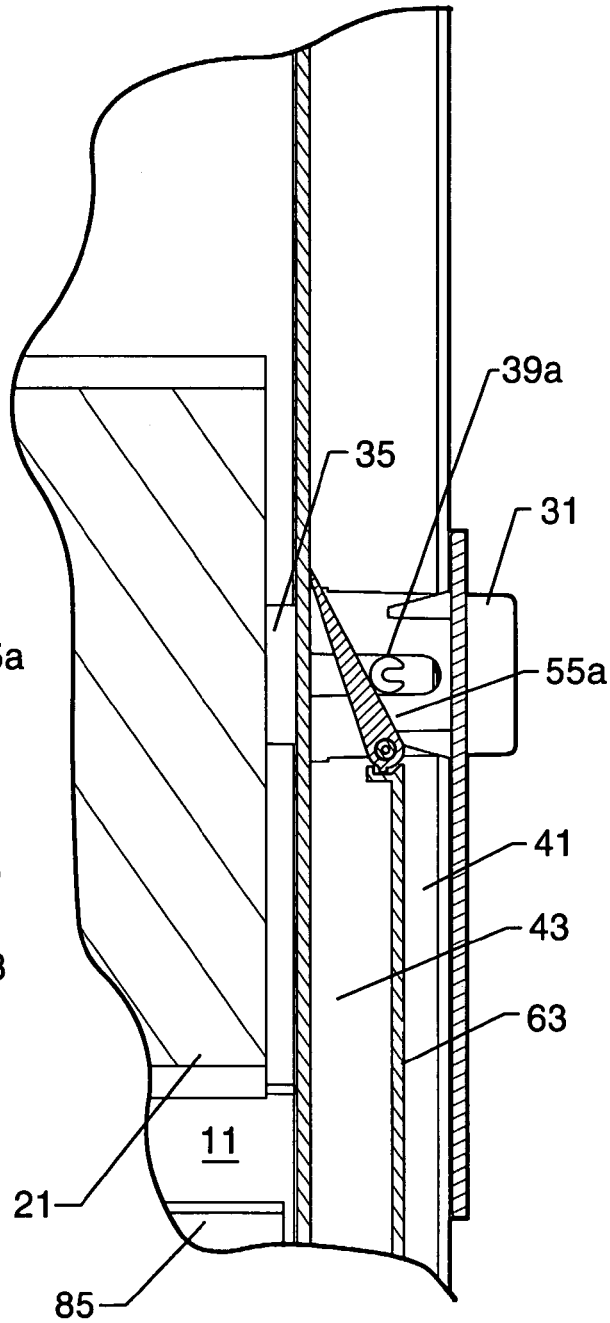

FIG. 6*a* shows an open front view of the elevator shaft 11 of dispenser 1 from the foregoing Figures, and FIG. 6*b* shows a blown up view of the right upper corner thereof. FIG. 7 shows a front view of the dispenser roll holder moving downward and about to retract the protrusion to release to roll, and move from the engaging position to the disengaging position. FIG. 8 shows a rotated oblique close up view of FIG. 7.

Figure 9:
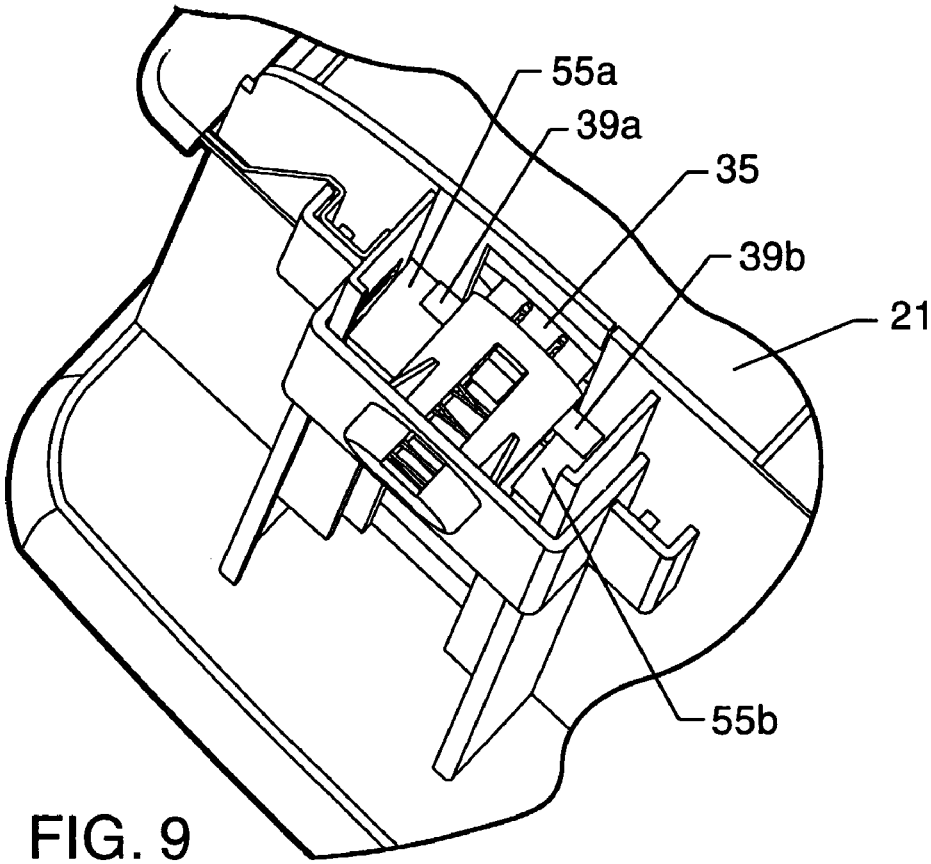
Figure 10:
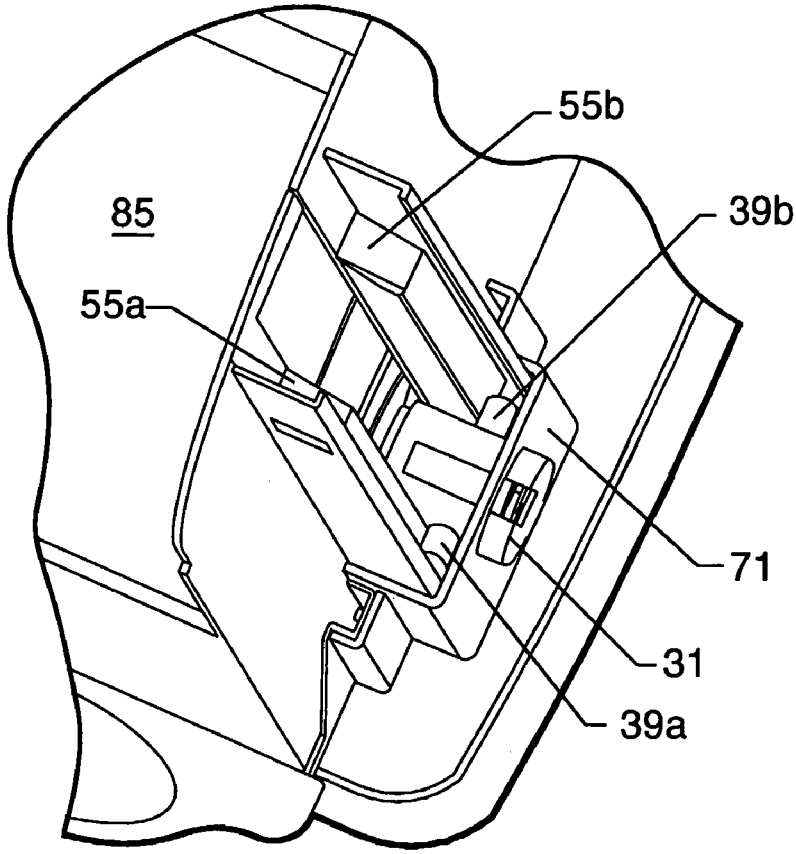

FIG. 9 shows a front view of the dispenser roll holder shown in FIG. 7, but down onto the directing lever and making the shift form its engaging to it disengaging position. FIG. 10 shows a top, oblique view of the same roll holder protrusion shown in FIGS. 6*a*, 6*b*, 7, 8, and 9, but now in the fully disengaged position.

FIGS. 6*a*, 6*b*, 7, 8, 9, and 10 are referred to collectively.

Roll holder right side 71 and left side 73 (FIG. 6*a*) are connected to the handle 15 (FIG. 10), not shown in FIGS. 6*a*, 6*b*, 7, 8 and 9, so as to move up and down in harmony with handle 15. There are opposing cylindrical holders 31 and 33 extending at right angles to sides 71 and 73, respectively, as shown. Protrusions 35 and 37 are moveably held in cylinders 31 and 33, respectively, and are biased outwardly, i.e. to their engaging positions, by springs, such as spring 95, to hold paper roll 21.

Track engagement means, here, pins 39*a* and 39*b* slide along the track sections. On the right arc track sections 41 and 43, separated by divider 63, and on the left arc track sections 51 and 53 separated by divider 65. First track sections 41 and 51 are opposing, as shown, and force the protrusions 35 and 37 into their disengaging positions when these protrusions are moved from top to bottom by handle 15.

Referring specifically to the right top area of dispenser 1, pins 39*a* and 39*b* are able to move in and out of their cylinder 31 and, since they are part of protrusion 35, would likewise move protrusion 35 correspondingly. Thus, in FIGS. 6*a* and 6*b*, the protrusion 35 is outward relative to side 71 and, hence, in its engaging position (here, actually engaging (holding) paper roll 21). This is shown in more detail in FIGS. 7 and 8.

As handle 15 is pushed down or pulled down, the roll holder side 71 moves down, and pin 39*a* and 39*b* slope down corresponding levers, (namely, lever 55*a* and 55*b*) and move the pins and its protrusion 35 inwardly toward side 71. This is a transition movement from an engaging position to a disengaging position. FIG. 9 shows the pin 39*a* sloping down lever 55*a* in this transition. FIG. 10 shows that the pins 39*a* and 39*b* have passed levers 55*a* and 55*b* and are in track section 41, with protrusion 35 pulled in (i.e. pulled away from roll 21), so as to have released roll 21 and ejected it (with sloping ejection means chute 85) via gravity. Pins 39*a* and 39*b* will travel in track section 41 until close to the bottom. Near the bottom, the divider 63 ends, and spring 95, pins 39*a* and 39*b* snap out to engage a waiting new roll. The handle 15 is pulled up, and the pins travel up second track section 43 with protrusion 35 fully inserted into the new roll, carrying it up to the top and holding it for use, until handle is again pulled down, repeating the same cycle. This process provided by dispenser 1 allows a user to simply reciprocate (pull down and up) to eliminate a spent roll, capture a new roll, place it in an ergonomically appropriate position and holding it for use until finished, then ejecting it on the next down cycle.

Figure 11:
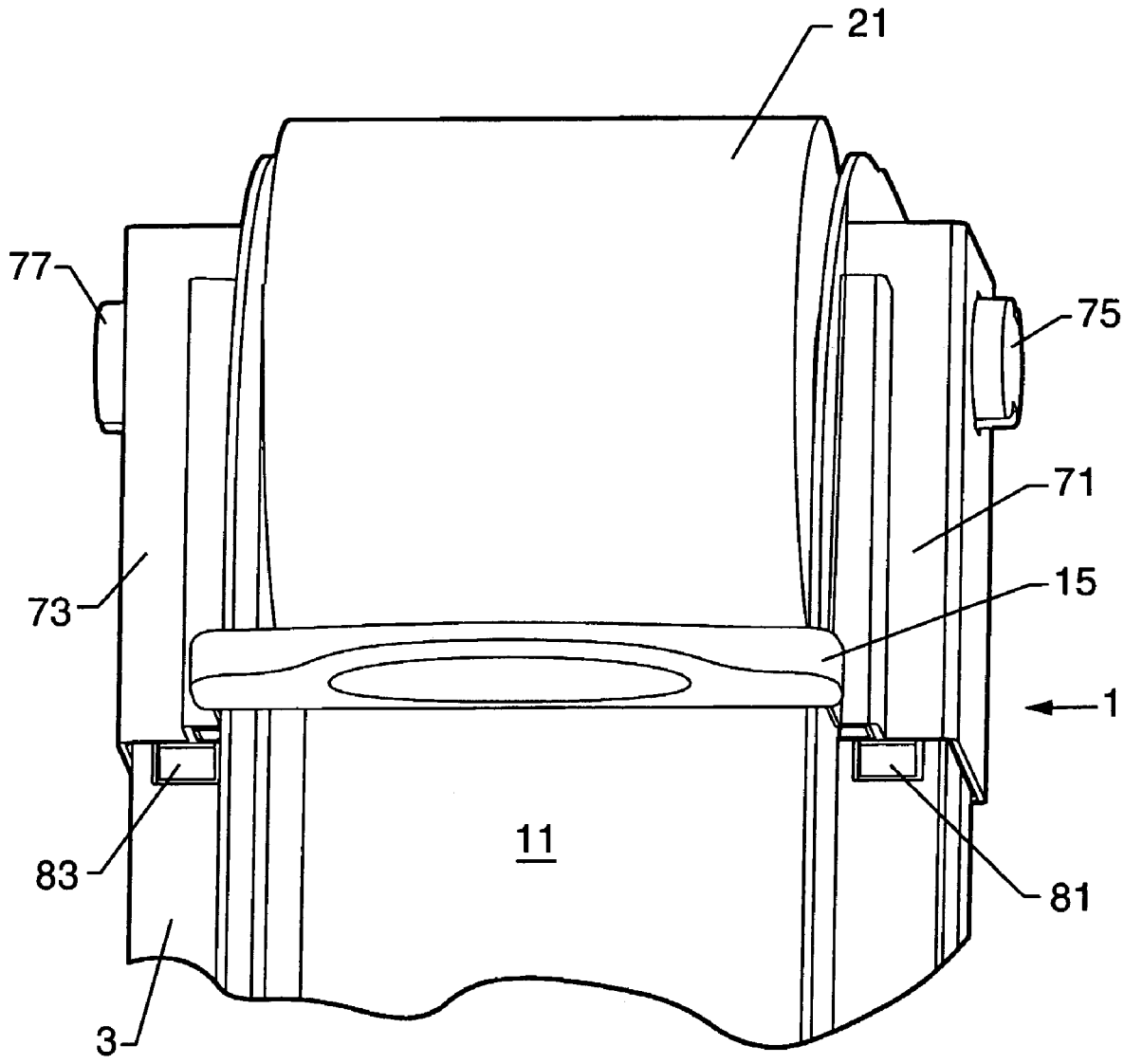
FIG. 11 shows a front oblique cut view of the upper portion of the present invention dispenser described above.

FIG. 11 shows a front oblique cut view of the upper portion of the present invention dispenser described above, and FIG. 12 shows a top cut view thereof. Identical components described above are identically numbered and need not by redescribed here. FIG. 11 shows that handle 15 is in its rest (top) position. Although not essential, some mechanism could be provided to encourage handle 15 to be in this position. This could be friction areas, one or more biasing springs pulling or pushing the handle to the top, ridges at the top, or, as shown in FIG. 11, integral cantilevered arms provide stops 81 and 83, with springs pushing out, for top position detent.

Figure 12:
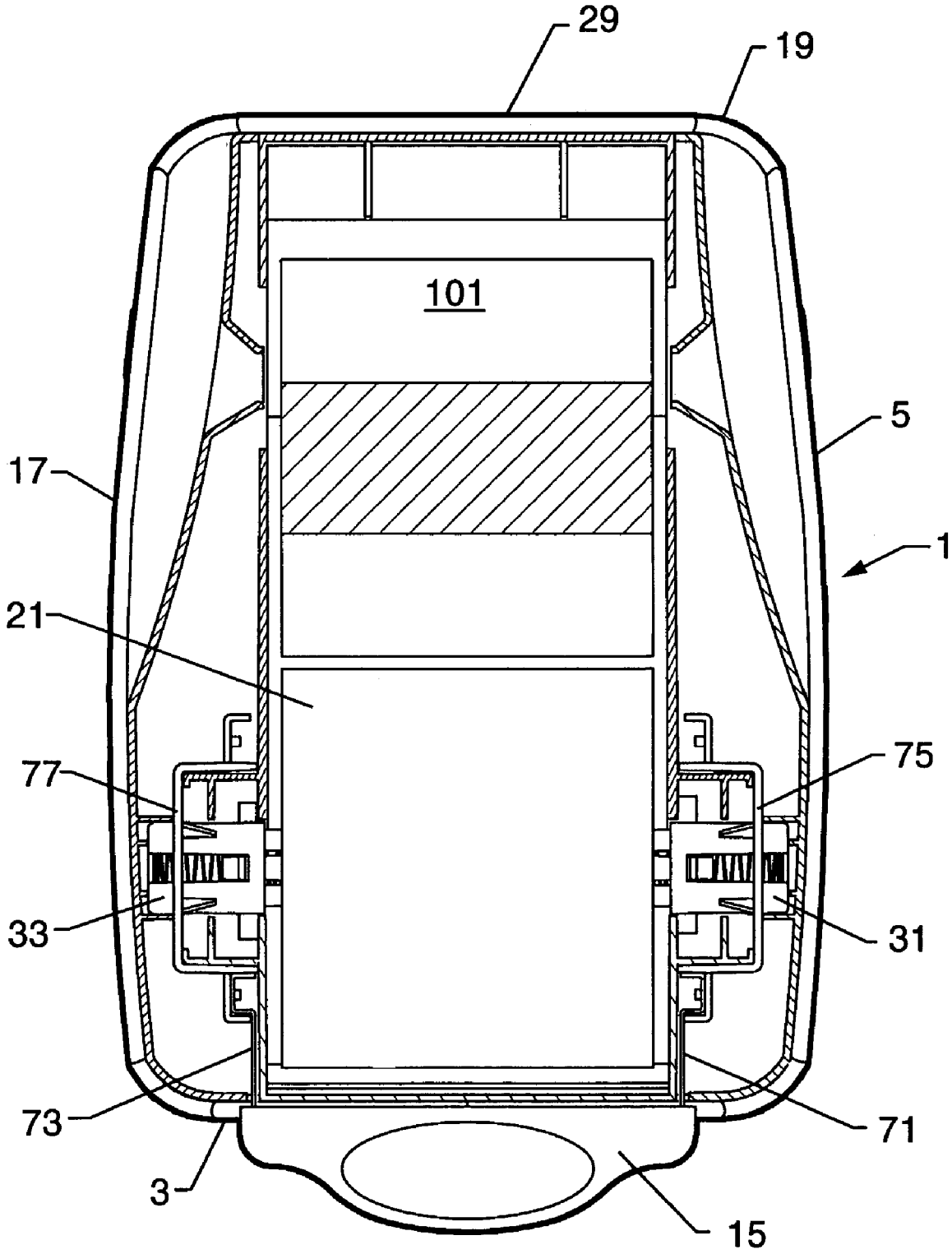
FIG. 12 shows a top cut view thereof.

FIG. 12 shows a roll storage and feeding mechanism section 101 in the back half of the dispenser 1, with top stored roll 121 exposed (because it is a cut view, otherwise hidden by lid 103 described in the earlier Figures). There is an inside frame 100 that has dimensions to comfortably receive paper rolls, as shown.

Figure 13:
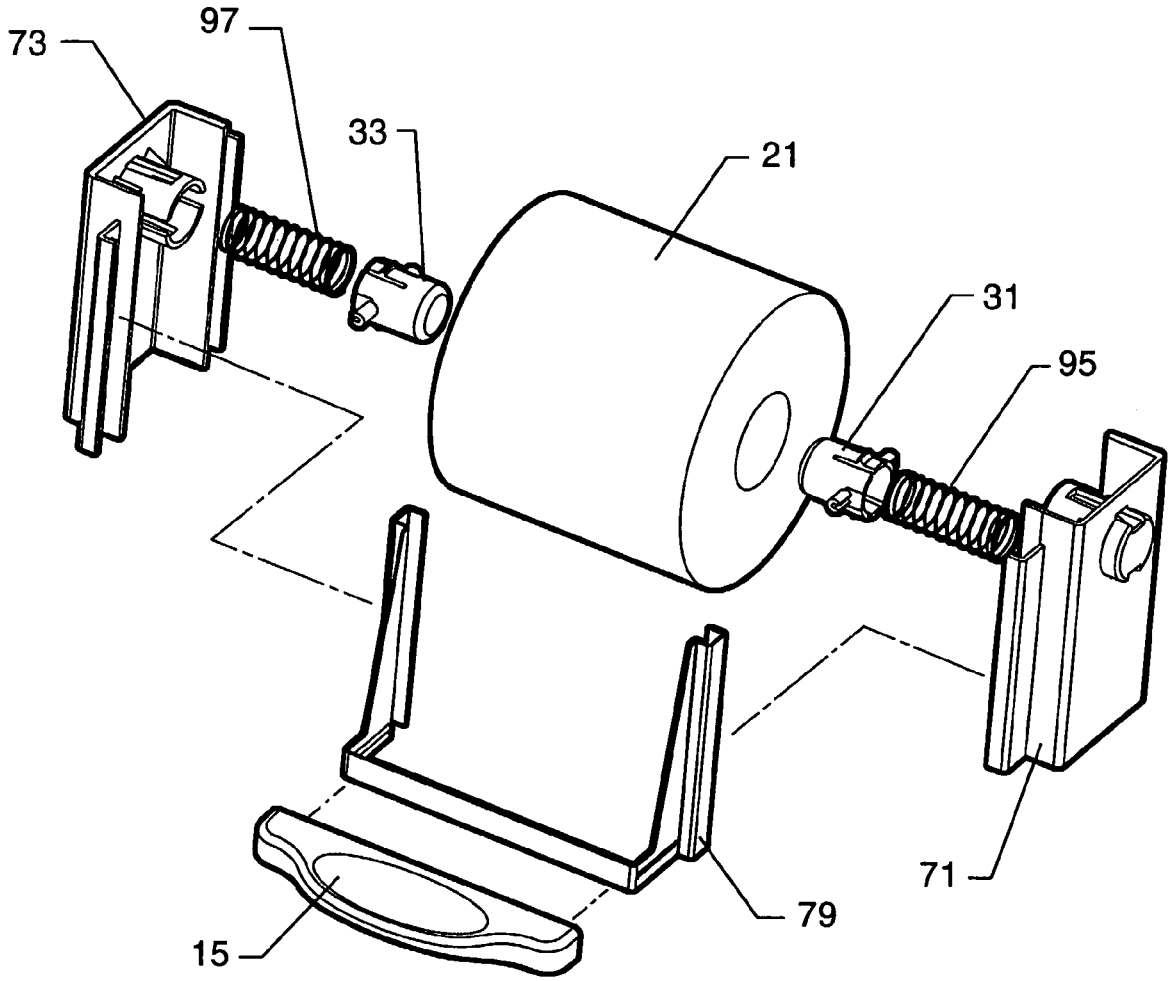
FIGS. 13, 14 and 15 show blown apart, top oblique and bottom oblique views of the handle roll holder and protrusions described above, all parts being identically numbered.
Figure 15:
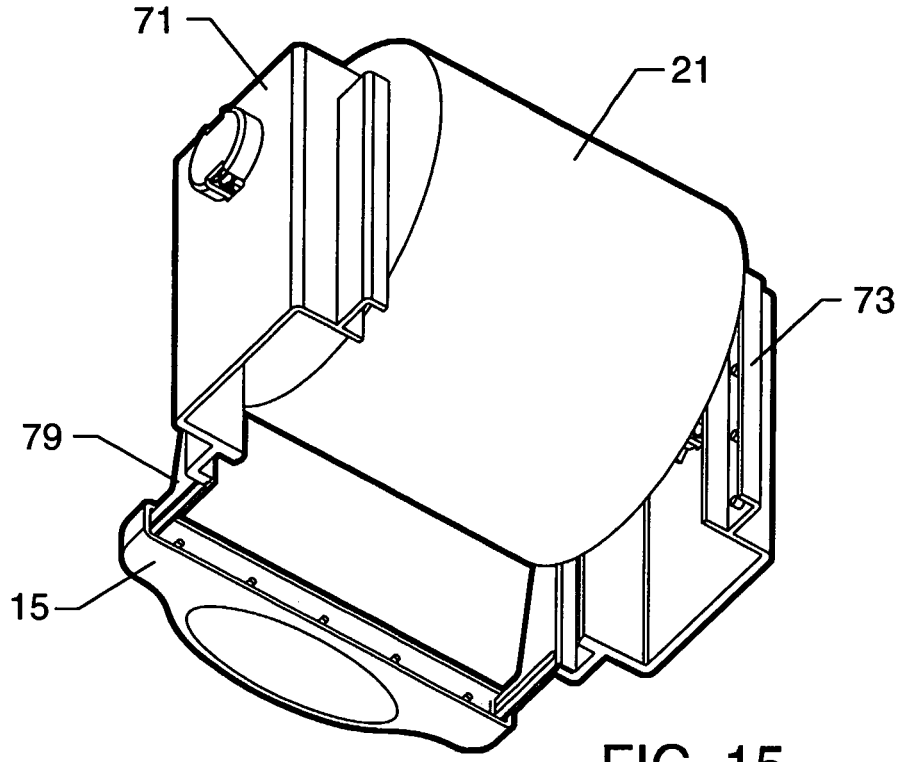
Figure 14:
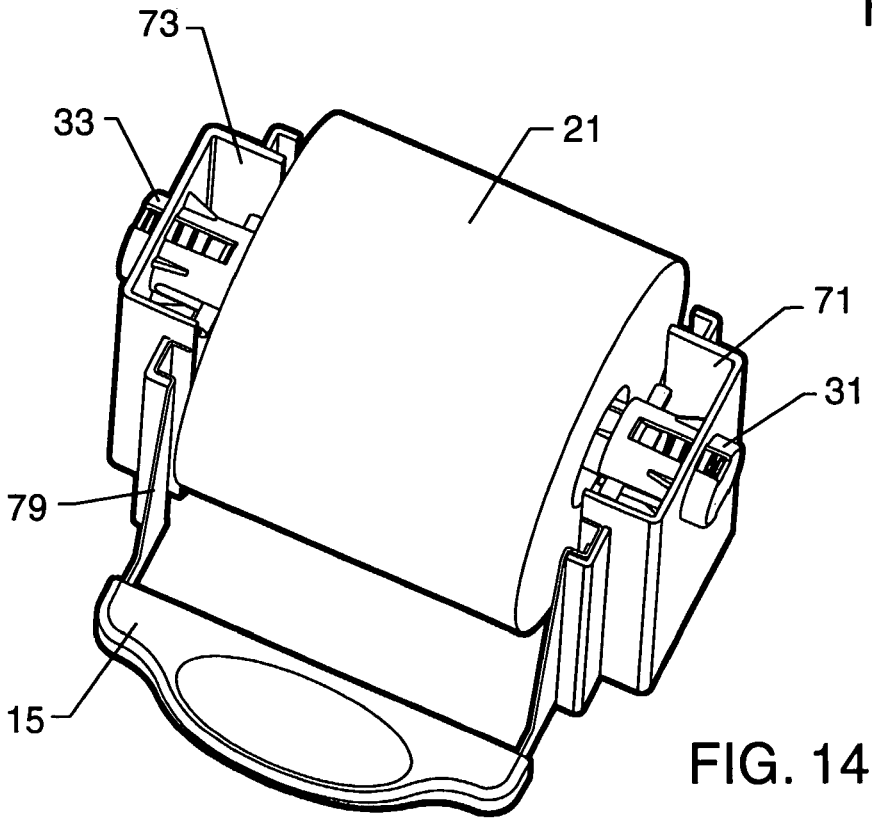

FIGS. 13, 14 and 15 show blown apart, top oblique and bottom oblique views of the handle roll holder and protrusions described above, all parts being identically numbered. Although two protrusions are shown, one long protrusion could be used instead. The long protrusion could be half or more of the width of the roll and move in and out of a longer cylinder.

In this example, assume that the distance between the inside ends of protrusions, i.e. a distance of separation in their engaging positions, is a linear distance X. Let X equal 3.5 inches. The roll 21 has a width of 5 inches. Let the total extent of the distance of the protrusions into the roll equal 1.5 inches, calling it a linear distance Y. The width of the roll is X+Y, or 5 inches. When the protrusions are in the disengaging positions, they will provide a total space, or clearance for ejection of the roll of 0.5 inches calling it a linear distance of 2. When the protrusions are in their disengaging position, they have a linear distance of separation of X+Y+Z, i.e. 5.5 inches. Note that X, the protrusion distance of separation, engaging, is less than the roll width X+Y, and that the roll with X+Y is less than the protrusion distance of separation, disengaging of X+Y+Z.

In FIG. 13, the components are blown apart to illustrate how the individual pieces fit and how they interact. Thus, handle 15 fits into the front of bracket 79 and roll holder sides 71 and 73 fit onto the side uprights of bracket 79. The springs 95 and 97 fit partially into the protrusions 35 and 37, and protrusions 35 and 37 snap into cylinders 31 and 33 so as to move back and forth therein from a spring-biased engaging position (rest position), to a disengaging position. The tracks and springs could be set up to bias inward, but the arrangement shown and described is preferred.

Figure 16:
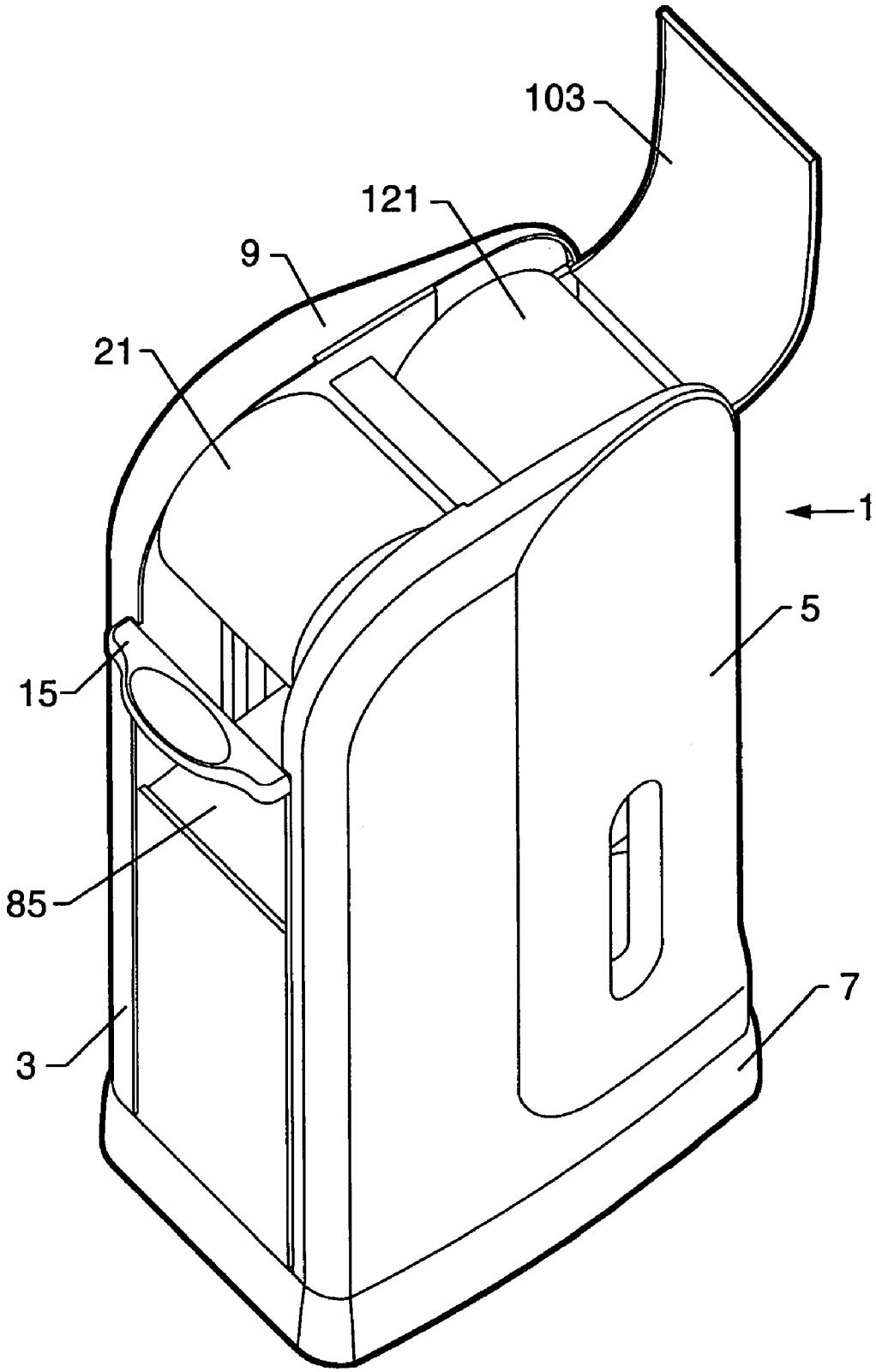
FIGS. 16, 17 and 18 show top, see through, side and cut side views of the present invention dispenser described above, illustrating the roll storage and feeding mechanism functionality.
Figure 17:
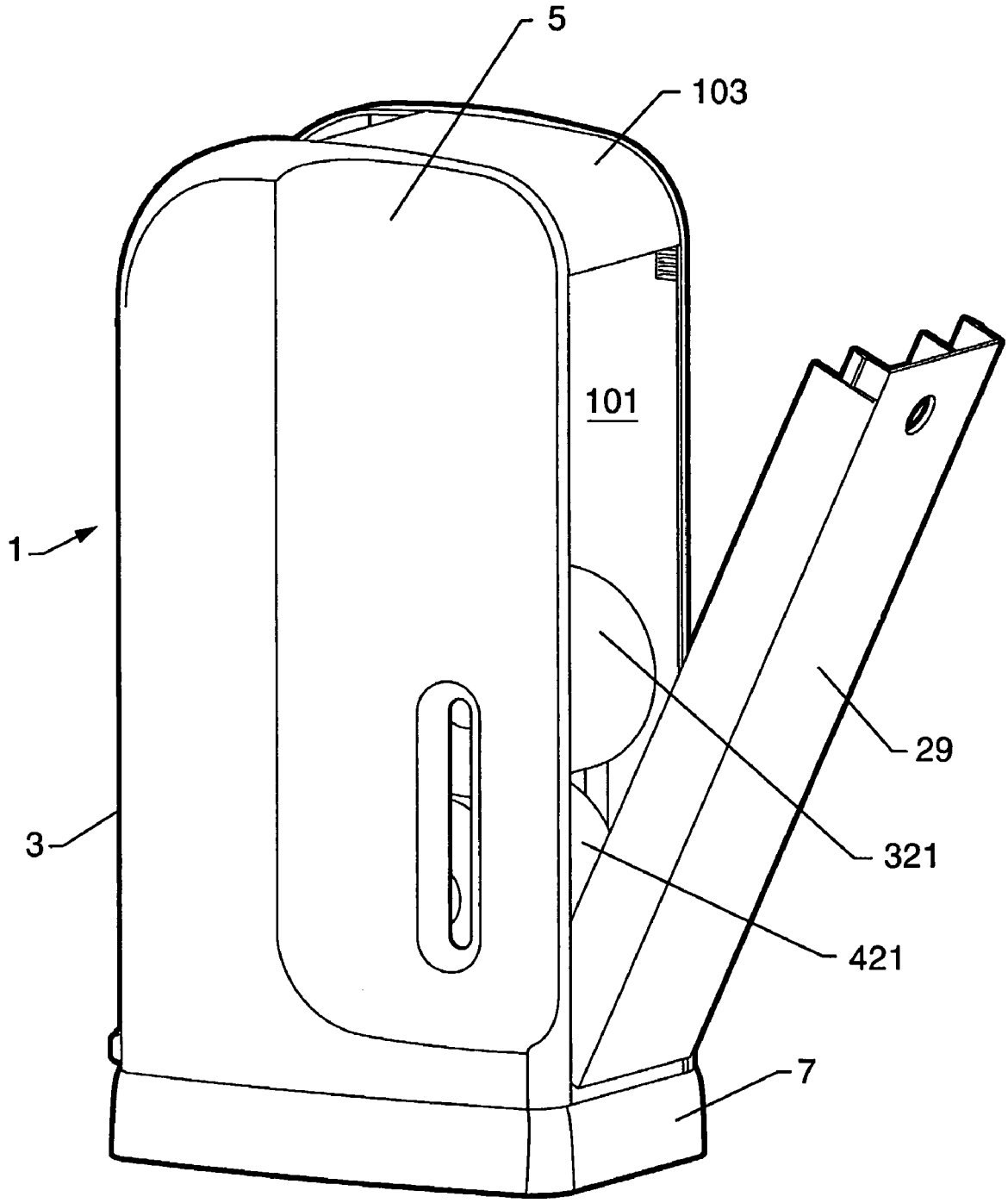
Figure 18:
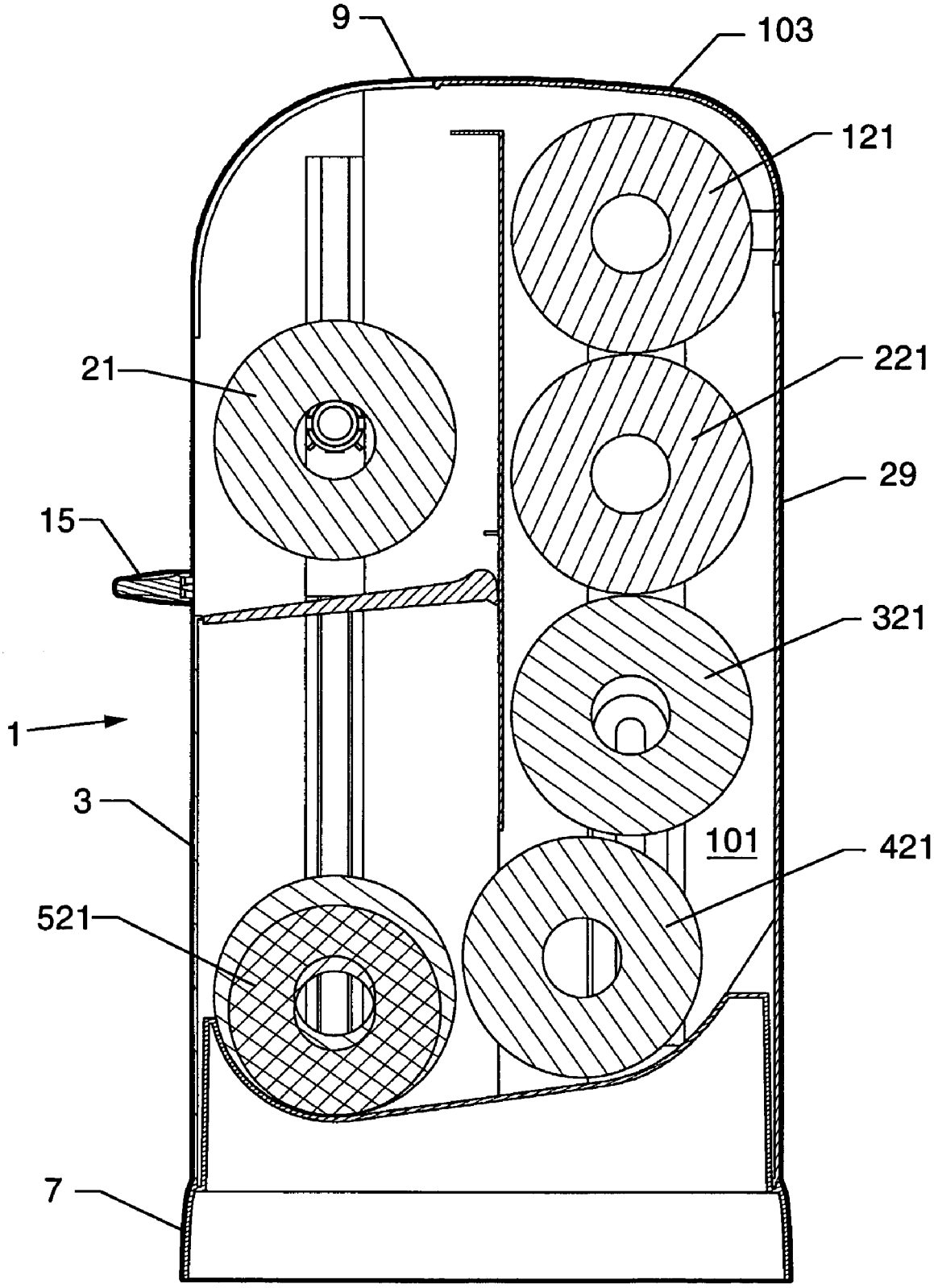

FIGS. 16, 17 and 18 show top, see through, side and cut side views of the present invention dispenser described above, illustrating the roll storage and feeding mechanism functionality. Identical parts shown above are identically numbered. Roll 121 is at the top of the stored stack of rolls 121, 221, 321, and 421. Sloped bottom 430 utilized gravity to move a bottom positional roll into the bottom of the elevator shaft for pick-up, such as the now-positional roll 521. Back door 29 has a top finger hole for easy opening, and any type of handle would be helpful.

Chute 85 swings up when a roll is being carried up into the top position, such as roll 21. On the other hand, when handle 15 is moved from top to bottom the spent roll is released as the protrusions disengage, and the chute 85 acts as an ejection ramp via gravity.

Figure 19:
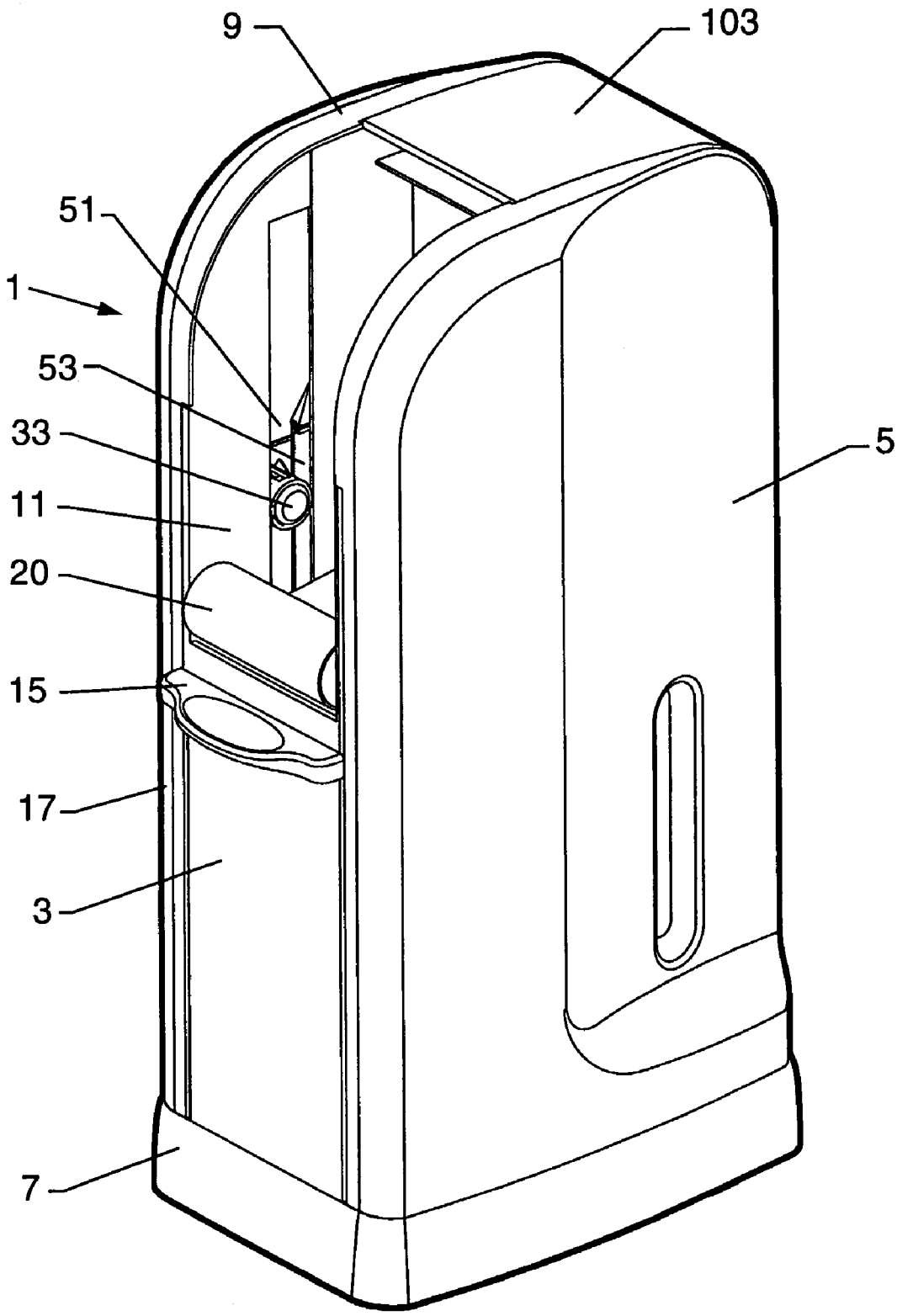
FIG. 19 shows the FIG. 1 present invention dispenser with an empty roll or tube being ejected; and, FIG. 20 shows a blown apart view of the entire assemblage of the present invention dispenser as one possible way of making components for large scale production.

FIG. 19 shows the FIG. 1 present invention dispenser with an empty roll or tube being ejected. Thus, tube 20 has been released by the downward movement of handle 15 and is rolling off chute 85.

As mentioned, the present invention dispenser may be made of different materials and have different dimensions to accommodate different types of rolls. Actual design and shape could also vary significantly. In the case of large production runs for a specific application or use, standard molding techniques, assemblage techniques and proven materials, thicknesses and styles could be used.

Figure 20:
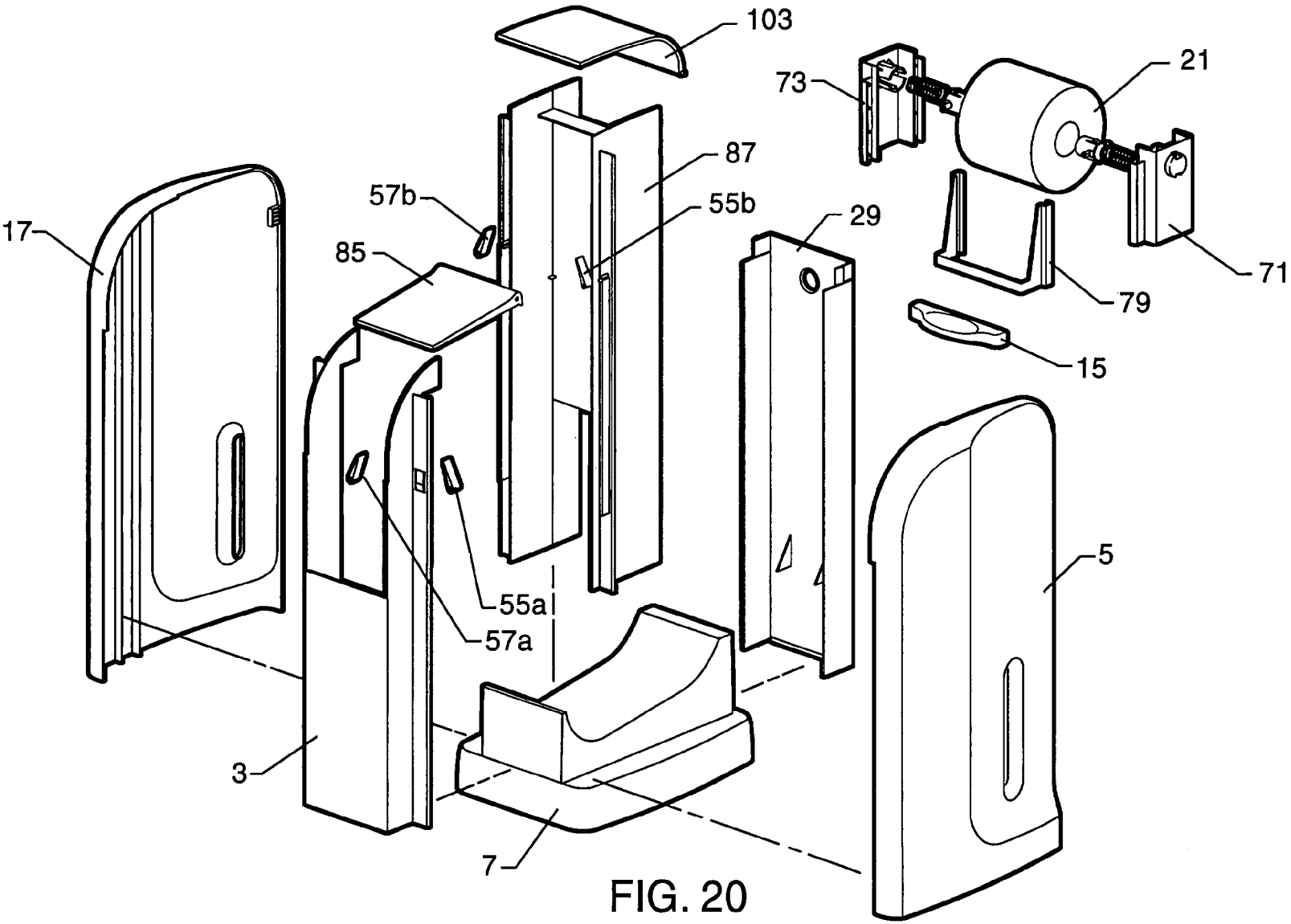

FIG. 20 shows a blown apart view of the entire assemblage of the present invention dispenser as one possible way of making components for large scale production.

As shown in FIG. 20, the sidewalls 5 and 17 are separate pieces, as are front 3, elevator shaft 87, bottom 7, and so on. Note, for example, that sloped feeding mechanism bottom 430 is integrally molded as part of bottom 7, and, while this is not an essential requirement to the functionality of the invention, it does provide for efficient one piece molding of that component, with the need for complex, expensive cam-action molds. Thus, all of the pieces shown in FIG. 20 have been designed to favor molding while still creating a preferred embodiment dispenser with all of the advantages and functions heretofore mentioned. Obviously, numerous modifications and variations of the present invention are possible in light of the above teachings. It is therefore understood that within the scope of the appended claims, the invention may be practiced otherwise than as specifically described herein.

What is claimed is:

1. An automatic positioning dispenser for paper rolls, which comprises:

(a) a main housing having a front section and a rear section, the front section of the main housing including a reciprocating paper roll elevator shaft, the rear section of the main housing including a paper roll storage and feeding mechanism;

(b) the elevator shaft having a handle, a roll holder and a reciprocal track, the roll holder having a roll engaging position and a roll disengaging position, the handle and roll holder being moveably connected to one another so as to move together along the reciprocal track, the reciprocal track having a first track section and a second track section, and the reciprocal track having a top and a bottom, wherein when the handle and the roll holder are located at the top of the reciprocal track, the roll holder is in the roll engaging position, and when the handle and roll holder are moved from the top to the bottom of the reciprocal track along its first track section, the roll holder is in the roll disengaging position, and when the handle and roll holder are at the bottom of the reciprocal track, the roll holder moves into the roll engaging position, and when the handle and roll holder are moved from the bottom to the top of the reciprocal track along its second track section, the roll holder is in the roll engaging position, such that the roll holder holds a paper roll at the top of the track, releases the paper roll when it moves from the top to the bottom, engages a new paper roll at the bottom and elevates the new paper roll to the top when moved from the bottom to the top; and, (c) said paper roll storage and feeding mechanism having sufficient storage area to store a plurality of paper rolls in sequential position, and having feeding means to move a paper roll from the storage area to the bottom of the elevator shaft.

2. The automatic positioning dispenser for paper rolls of claim 1 wherein said paper roll storage and feeding mechanism is a single roll width-based storage chute with an inclining base positioned to rely upon gravity feed to move paper rolls from it to said bottom of said elevator shaft.

3. The automatic positioning dispenser for paper rolls of claim 2 wherein said paper roll storage and feeding mechanism includes at least one access door for loading it with a plurality of paper rolls.

4. The automatic positioning dispenser for paper rolls of claim 1 wherein said paper roll storage and feeding mechanism includes at least one access door for loading it with a plurality of paper rolls.

5. The automatic positioning dispenser for paper rolls of claim 1 wherein said paper roll storage and feeding mechanism includes sufficient storage area to hold at least three rolls of toilet paper.

6. The automatic positioning dispenser for paper rolls of claim 1 wherein said elevator shaft includes a spent paper roll ejection means located below said top to eject a spent paper roll when said handle is moved from said elevator shaft top downwardly along said first track section.

7. The automatic positioning dispenser for paper rolls of claim 1 wherein said roll holder includes two opposing protrusions having an outside dimension to fit inside a hollow paper roll, one of said two opposing protrusions having track engagement means which is functionally connected to said reciprocal track.

8. The automatic positioning dispenser for paper rolls of claim 7 wherein said two opposing protrusions have a distance of separation of X when said roll holder is in its roll engaging position to engage a paper roll having a hollow roll width of X+Y, and said two opposing protrusions have a distance of separation of X+Y+Z when said roll holder is in its roll disengaging position, wherein each of X, Y, and Z is a linear measurement, and wherein X is less than X+Y and X+Y is less than X+Y+Z.

9. The automatic positioning dispenser for paper rolls of claim 1 wherein said elevator shaft includes at least one vertical opening for movement of said handle upwardly and downwardly, and wherein said handle extends into said shaft and is functionally connected to said roll holder therein.

10. The automatic positioning dispenser for paper rolls of claim 1 wherein said roll holder is spring biased toward said roll engaging position.

11. An automatic positioning dispenser for paper rolls, which comprises:

(a) a main housing having a front section and a rear section, the front section of the main housing including a reciprocating paper roll elevator shaft, the rear section of the main housing including a paper roll storage and feeding mechanism;

(b) the elevator shaft having a handle, a roll holder and two opposing reciprocal tracks, the roll holder having a roll engaging position and a roll disengaging position, the handle and roll holder being moveably connected to one another so as to move together along the reciprocal tracks, each of the reciprocal tracks having a first track section and a second track section, and each of the reciprocal tracks having a top and a bottom, wherein when the handle and the roll holder are located at the top of the reciprocal tracks, the roll holder is in the roll engaging position, and when the handle and roll holder are moved from the top to the bottom of the reciprocal tracks along their first track sections, the roll holder is in the roll disengaging position, and when the handle and roll holder are at the bottom of the reciprocal tracks, the roll holder moves into the roll engaging position, and when the handle and roll holder are moved from the bottom to the top of the reciprocal tracks along their second track sections, the roll holder is in the roll engaging position, such that the roll holder holds a paper roll at the top of the tracks, releases the paper roll when it moves from the top to the bottom, engages a new paper roll at the bottom and elevates the new paper roll to the top when moved from the bottom to the top; and, (c) said paper roll storage and feeding mechanism having sufficient storage area to store a plurality of paper rolls in sequential position, and having feeding means to move a paper roll from the storage area to the bottom of the elevator shaft.

12. The automatic positioning dispenser for paper rolls of claim 11 wherein said paper roll storage and feeding mechanism is a single roll width-based storage chute with an inclining base positioned to rely upon gravity feed to move paper rolls from it to said bottom of said elevator shaft.

13. The automatic positioning dispenser for paper rolls of claim 12 wherein said paper roll storage and feeding mechanism includes at least one access door for loading it with a plurality of paper rolls.

14. The automatic positioning dispenser for paper rolls of claim 11 wherein said paper roll storage and feeding mechanism includes at least one access door for loading it with a plurality of paper rolls.

15. The automatic positioning dispenser for paper rolls of claim 11 wherein said paper roll storage and feeding mechanism includes sufficient storage area to hold at least three rolls of toilet paper.

16. The automatic positioning dispenser for paper rolls of claim 11 wherein said elevator shaft includes a spent paper roll ejection means located below said top to eject a spent paper roll when said handle is moved from said elevator shaft top downwardly along said first track section.

17. The automatic positioning dispenser for paper rolls of claim 11 wherein said roll holder includes two opposing protrusions having an outside dimension to fit inside a hollow paper roll, each of said two opposing protrusions having track engagement means which is functionally connected to said reciprocal track.

18. The automatic positioning dispenser for paper rolls of claim 17 wherein said two opposing protrusions have a distance of separation of X when said roll holder is in its roll engaging position to engage a paper roll having a hollow roll width of X+Y, and said two opposing protrusions have a distance of separation of X+Y+Z when said roll holder is in its roll disengaging position, wherein each of X, Y, and Z is a linear measurement, and wherein X is less than X+Y and X+Y is less than X+Y+Z.

19. The automatic positioning dispenser for paper rolls of claim 11 wherein said elevator shaft includes at least one vertical opening for movement of said handle upwardly and downwardly, and wherein said handle extends into said shaft and is functionally connected to said roll holder therein.

20. The automatic positioning dispenser for paper rolls of claim 19 wherein said roll holder is spring biased toward said roll engaging position.

* * * * *